United States Patent [19]

Moberg

[11] Patent Number: 4,521,195

[45] Date of Patent: Jun. 4, 1985

[54] DEVICE FOR SIMULATING THE REPORT EFFECT OF A BLANK CARTRIDGE WHEN FIRING SMALL ARMS

[76] Inventor: Kurt E. L. Moberg, Box 94060, S-541 04 Skövde, Sweden

[21] Appl. No.: 574,029

[22] PCT Filed: May 2, 1983

[86] PCT No.: PCT/SE83/00174

§ 371 Date: Dec. 30, 1983

§ 102(e) Date: Dec. 30, 1983

[87] PCT Pub. No.: WO83/03893

PCT Pub. Date: Nov. 10, 1983

[30] Foreign Application Priority Data

May 3, 1982 [SE] Sweden ..... 8202762

[51] Int. Cl.[3] ..... F42D 7/00

[52] U.S. Cl. ..... 434/16

[58] Field of Search ..... 434/16, 18

[56] References Cited

U.S. PATENT DOCUMENTS

| | | | |
|---|---|---|---|
| 3,238,642 | 3/1966 | Ohlund | 434/16 |
| 3,272,510 | 9/1966 | Ohlund | 434/16 |
| 3,334,425 | 8/1967 | Ohlund | 434/16 |
| 3,423,848 | 1/1969 | Ohlund | 434/16 |
| 4,302,190 | 11/1981 | Shaw et al. | 434/18 |
| 4,380,437 | 4/1983 | Yarborough, Jr. | 434/18 |

*Primary Examiner*—William H. Grieb

*Attorney, Agent, or Firm*—Young & Thompson

[57] ABSTRACT

A device intended to provide sound reports similar to those occuring when firing with live ammunition when firing small arms. The device is implemented as a magazine which can be fitted to a weapon instead of its ordinary magazine. In the device there is a pressurized gas container (11), e.g. for compressed air, the gas being used to fill a dosing chamber (13) with the aid of a valve means (16,14) actuable by the weapon trigger. The dosing chamber can be opened momentarily so that the compressed air enclosed therein streams out and expands with a report.

5 Claims, 3 Drawing Figures

FIG.1
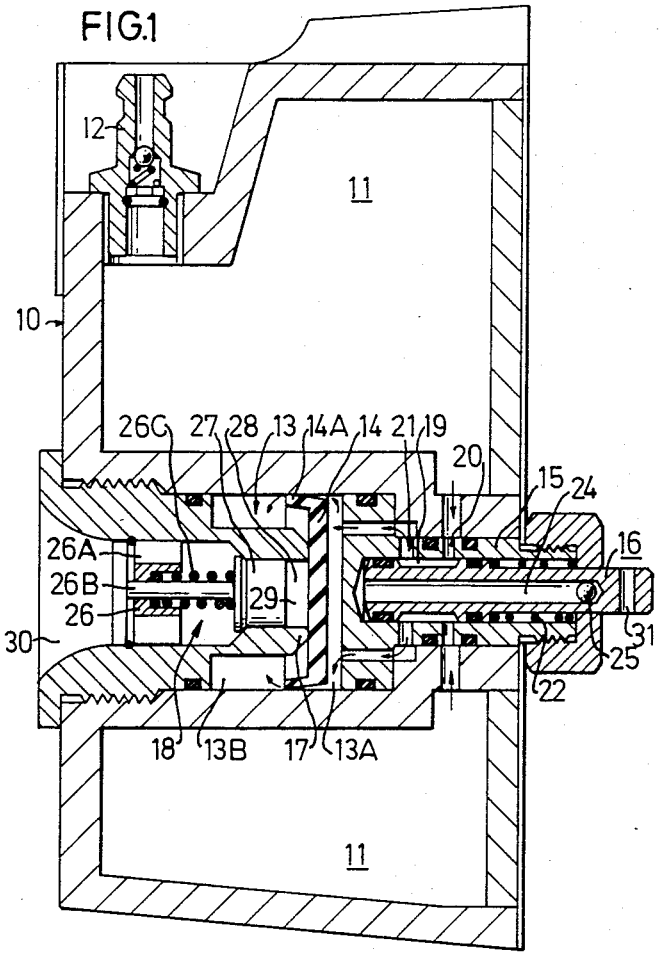
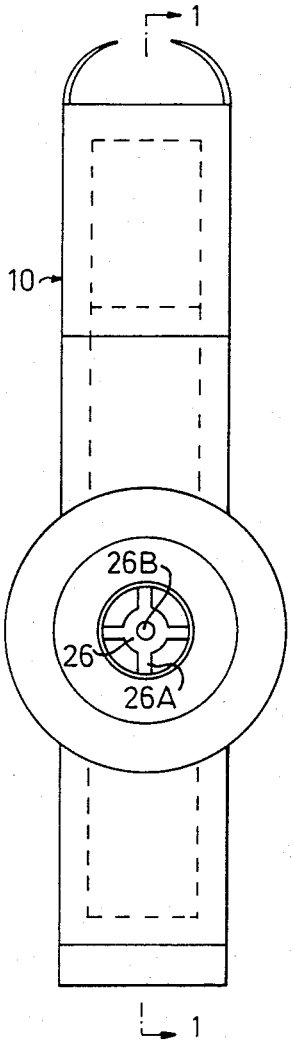
FIG. 2
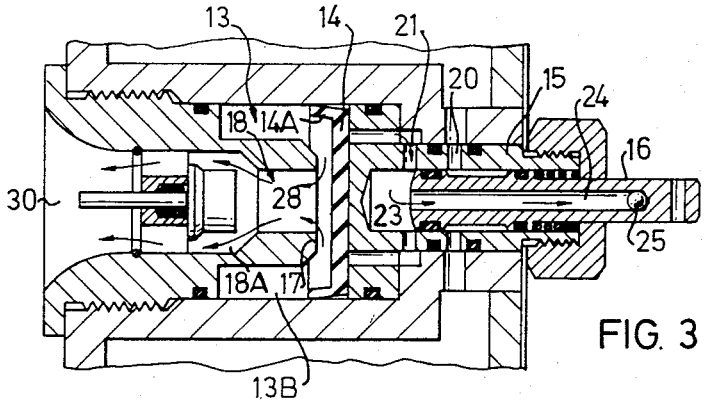
FIG. 3

DEVICE FOR SIMULATING THE REPORT EFFECT OF A BLANK CARTRIDGE WHEN FIRING SMALL ARMS

The present invention relates to a device for simulating the report effect of a blank cartridge when firing small arms.

Firing blank cartridges is performed at present in the use of small arms by loading the magazine of the weapon with rounds having a propulsion charge but no bullet. Manufacturing, transport handling and storing of the blank cartridges result in costs which can amount to a considerable sum per year. The object of the present invention is therefore to provide a device which makes it possible to provide the desired report effects of blank cartridges when firing small arms in a way such that the costs for firing with blank cartridges is considerably reduced in relation to the above mentioned costs.

This is achieved with a device working with a compressed gas such as compressed air, the device in accordance with the invention having the characterizing features defined in the following claims.

In the inventive device there is thus a housing which is fitted to the weapon instead of the ordinary cartridge magazine, the housing containing a first valve which can be coupled to the trigger of the weapon via a link system. In the housing there is a compressed air container in the form of a chamber provided with a nipple, to which a hand-driven pump may be connected for charging the container with compressed air. Alternatively, an exchangeable container may be used, which is charged beforehand with the aid of a stationary compressed air source. When the trigger is activated, communication between the compressed air container and a dosing chamber is closed with the aid of a first valve, a second valve being simultaneously activated to open the outlet from the dosing chamber, from which a predetermined quantity of compressed air flows out to the atmosphere with a report. When the trigger is released and returned to the rest position, the dosing chamber will be recharged.

A suitable embodiment of the device in accordance with the invention is shown as an example on the accompanying drawing.

FIG. 1 is a section through a device in accordance with the invention, taken along the line 1—1 in FIG. 2, FIG. 2 is a view of the device seen from the front, and FIG. 3 illustrates the valves in a position corresponding to completely depressed trigger for letting out a quantity of compressed air with a report effect.

In the Figures there is shown a housing 10 with approximately the same size and shape as a conventional cartridge magazine for a weapon such as an automatic carbine. This housing can be fitted to the weapon instead of the cartridge magazine.

In the housing there is a compressed air chamber 11 which, via a nipple 12 and non-return valve, can be filled with a pressurized gas such as compressed air with the aid of a hand-operated pump or in some other way.

In the housing there is also a cylindrical dosing chamber 13 which, with the aid of an axially movable piston disc 14, is divided into an inlet chamber 13A and an outlet chamber 13B. The piston disc is provided at its edge with a lip sealing 14A, functioning as a one-way valve for the stream of compressed air from the chamber 13A to the chamber 13B when the chamber 13A is filled with compressed air, but which prevents flow back in the opposite direction.

A valve housing 15 is also included in the device, and has a slide valve 16 in the form of a plunger which is movable between two end positions to form a first valve in the device.

The piston disc 14 coacts with a seat 17 at the inlet end of a throat forming an outlet 18 from the outlet chamber 13 of the compressed air chamber, the piston disc functioning as a second valve in the device.

The slide valve 16 has an annular groove 19 which, in the open position of the valve shown in FIG. 1, opens the communication between a radial channel 20 from the chamber 11 to a channel 21 leading the compressed air to the inlet chamber 13A, the piston disc 14 then being pressed against the seat 17 to close the outlet 18. The supplied compressed air flows past the elastic lip 14A to charge the outlet chamber 13B, the volume of which in the illustrated example determines the predetermined quantity of compressed air which is to be released through the outlet.

In FIG. 1, the slide valve 16 is in its inner position and is kept in this position by a compression spring 22. Since the gas forces on the slide valve are balanced out in the annular groove 19, the spring 22 can be relatively weak, and this is an advantage, taking into account that the resistance to withdrawal of the slide valve to its outward end position in FIG. 3 should not be greater than the position in FIG. 3 being enabled with ordinary pressure on the trigger. Between a hole 31 in the outer end of the slide valve and an unillustrated trigger of a small arms weapon there is a link mechanism for translating the motion of the trigger to the slide valve.

When motion of the slide valve 16 from the position in FIG. 1 towards the end position in FIG. 3 is initiated, nothing happens as long as the groove 19 has communication with the channel 21. The forward portion of the slide valve will close off the channel 21 in a given position and for continued withdrawal there is achieved an intermediate position where the inner end of the slide valve has passed the opening of the channel 21 so that the channel opens freely into the bottom chamber 23, formed between the inner end of the slide valve and the bottom of the bore for the slide valve mounting. This chamber communicates in turn with a central channel 24 in the slide valve, the central channel accordingly being connected to the atmosphere via a hole 25 when the slide valve is in its utmost position according to FIG. 3.

In said intermediate position for the slide valve, there is provided a momentary emptying of the inlet chamber 13A, in turn resulting in that the compressed air in the chamber 13B urges the piston disc 14 back again towards its open position in FIG. 3, and the compressed air in the chamber 13B streams out through the throat 18 to expand with a report.

The intermediate position described thus corresponds to the pressure point for pulling the trigger which is to be found in most small arms, triggering for an air report will thus take place with the same feeling as for triggering an ordinary shot.

From the intermediate position, compressed air in the chamber 23 takes over the continued displacement of the slide valve to its utmost position, and as soon as both chambers 13A and 13B have been emptied, the spring 22 will urge the slide valve 16 back into its inward position according to FIG. 1 for once again filling the chambers 13A and 13B with compressed air.

There is a hub 26 carried by a plurality of spokes 26A in the throat 18. A shaft 26B is displaceably mounted in the hub 26 and carries at its inner end a valve plunger 27 forming a third valve. In its closed position the plunger is disposed, according to FIG. 1, in a bore 28 partially filled by the plunger but leaving a small chamber 29 free in the closed position. The valve plunger is kept in its closed position by a compression spring 26C which is biased between the hub and plunger.

When the piston disc 14 is open, the chamber 29 is filled first until the pressure in it is sufficiently large to displace the plunger 27 to its open position in FIG. 3, where the compressed air streams past the plunger in an expanded portion 18A of the throat, past the spokes 26A and out through the funnel-shaped outlet end 30 of the outlet, this funnel being formed to give the best possible report effect during the expansion of the compressed air.

The illustrated device can be charged to fire about 20 shots, after which the housing 10 can be replaced by a housing with a charged chamber 11, or the chamber 11 can be filled with air to a desired pressure with the air of a hand pump.

It will be seen from the above that the cost of firing an "air shot" will be several times less than the cost of firing a shot with blank cartridges.

The weight of the weapon will be approximately the same as for an ordinary cartridge magazine, but the need for carrying a supply of blank cartridges is avoided. The extra weight from a small hand pump is not troublesome.

I claim:

1. A device for simulating the report effect of a blank cartridge when firing small arms, comprising a pressurized gas container (11) and a dosing chamber (13) that are mutually communicable via a communication which can be opened and closed by means of a first valve (16), the dosing chamber having an outlet (18,30) opening out into the surrounding atmosphere and which can be opened and closed with the aid of a second valve (14), the first and second valves being adapted such that when one is closed the other is opened and vice versa, the first valve being adapted to be actuated by the intermediary action of a weapon trigger so that actuation of the trigger results in closing the first valve and opening the second valve for momentary exhaust of a predetermined quantity of gas from the dosing chamber (13B) through the outlet while generating the intended sound shock.

2. A device as claimed in claim 1, in which the dosing chamber is cylindrical and has a throat (18) centrally situated inside the chamber, forming the outlet and which is closable with the aid of a second valve in the form of an axially movable piston disc (14), dividing the dosing chamber into an inlet chamber (13A) and an outlet chamber (13B), such that when the piston disc is in its open position the outlet chamber is in open communication with the outlet, the piston disc having a one-way valve allowing passage of the pressurized gas from the inlet chamber to the outlet chamber, but preventing the passage of gas in the opposite direction, so that opening the first valve results in the supply of pressurized gas to the inlet chamber and the outlet chamber simultaneously as the outlet is closed by the second valve, while closing of the first valve is adapted to open communication between the surrounding atmosphere and the inlet chamber for venting the latter, resulting in that the compressed air in the outlet chamber (13B) momentarily opens the second valve and streams out through the outlet.

3. A device as claimed in claim 2, in which the first valve comprises a slide valve (16) with an annular groove (19), which, in one end position of the valve joins a channel (20) from the compressed air container to a channel (21) to the inlet chamber (13A) and in an intermediate position closes the channel (20) to the inlet chamber for opening during continued displacement in a direction towards the second end position of the valve a communication between the inlet chamber channel (20) and the atmosphere for venting the inlet chamber and thereby opening the outlet, whereby the intermediate position functions as a conventional firing squeeze.

4. A device as claimed in claim 3, in which the slide valve (16) has a central channel (24) opening out into the atmosphere (25), a communication between this channel and the inlet chamber (13A) opening when the valve is in the vicinity of, and in its second end position.

5. A device as claimed in claim 1 in which the outlet comprises a throat and a spring-biased third valve (27) therein, this valve in a closed position forming an antichamber (29) between said valve and the second valve, the spring bias on the third valve being such that the third valve is not opened before a predetermined gas pressure has been reached in the antichamber (29).

* * * * *